US005647074A

United States Patent [19]

White, Jr. et al.

[11] Patent Number: 5,647,074

[45] Date of Patent: Jul. 15, 1997

[54] PUBLIC TOILET FACILITY

[76] Inventors: John N. White, Jr.; Cynthia R. Sours, both of 64 W. Belle Isle Rd., NE., Atlanta, Ga. 30342

[21] Appl. No.: 596,627

[22] Filed: Feb. 5, 1996

Related U.S. Application Data

[63] Continuation of Ser. No. 254,983, Jun. 7, 1994, abandoned.

[51] Int. Cl.[6] ..... A47K 4/00; E03C 1/01

[52] U.S. Cl. ..... 4/664; 4/312

[58] Field of Search ..... 4/300, 312, 460, 4/662, 663, 664

[56] References Cited

U.S. PATENT DOCUMENTS

| | | | |
|---|---|---|---|
| 3,436,764 | 4/1969 | Colonna . | |
| 3,447,167 | 6/1969 | Harding . | |
| 3,601,821 | 8/1971 | Corsiglia . | |
| 3,837,011 | 9/1974 | McTighe et al. . | |
| 4,045,827 | 9/1977 | Morris . | |
| 4,210,973 | 7/1980 | Decaux . | |
| 4,262,372 | 4/1981 | Ryder . | |
| 4,301,558 | 11/1981 | Decaux . | |
| 4,642,821 | 2/1987 | Zanuso et al. . | |
| 4,868,936 | 9/1989 | Crocoli | 4/664 X |

FOREIGN PATENT DOCUMENTS

| | | | |
|---|---|---|---|
| 0235008 | 9/1987 | European Pat. Off. | 4/664 |
| 2123046 | 1/1984 | United Kingdom . | |

OTHER PUBLICATIONS

6 Patent Office Official Gazette Abstracts.

Vermont Structural Slate Company, Inc., "Urban Outhouse Design Competition—Competition Brief", Nov. 1992.

"Adventure, Nature and Technology: All for a Quarter", New York Times, Section B, Aug. 5, 1992.

"European Conveniences", New York Times, Section 4, Jul. 5, 1992.

"Gift May Put Lid On Self-Cleaning Toilets", New York Times, Jun. 5, 1992.

"Pay-Toilet Measure Is On Cuomo's Desk", New York Times, Section B, Mar. 31, 1993.

"Step Right Up and Look Inside", New York Times, Section B, Aug. 5, 1992.

Sketch, Mar. 1994, vol. II, No. 3, Thompson, Ventulett, Stainback & Assoc.

"Bowl Games", The Upper East Side Resident, Jun. 17–Jul. 1.

"Where Is It When We Need It?", Washington Post, Jul. 16, 1993, p. B5.

"Bringing Restrooms to the Street", Los Angeles Times, Sep. 29, 1993.

"The Flush of Genius: Exhibit Extols the Fine Art of the Street Loo", Daily News, Jul. 29, 1993.

"Berlin Concern Agrees to Build Public Toilets", The New Yorker, Jul. 12, 1993.

PSA International 1991 Industry Catalog, Portable Sanitation Assoc. International.

"Public Privies Open, and None Too Soon", New York Times.

"New York Resumes Quest for Public Toilets", New York Times, Aug. 10, 1994.

"Restrooms for Folks Who Aren't Patrons", Wall Street Journal.

*Primary Examiner*—Charles E. Phillips

*Attorney, Agent, or Firm*—Jones & Askew

[57] ABSTRACT

A public toilet facility which is self-cleaning, automatic, and handicapped accessible. The facility offers a toilet that not only lowers from a vertical position to a horizontal position, but can be adjusted vertically to different heights. The compact facility has a semicircular door, which is stored behind the equipment and machinery compartment when the facility is unoccupied. This design makes the facility adaptable for narrow sites in that when unoccupied, the facility only takes up the semicircular foot print on the side walk. A spacious interior is created only when the unit is in use.

13 Claims, 15 Drawing Sheets

PUBLIC TOILET FACILITY

This is a continuation of application Ser. No. 08/254,983, filed Jun. 7, 1994, now abandoned.

FIELD OF THE INVENTION

This invention relates to a public toilet and lavatory unit, and more specifically relates to an automatic, self-cleaning, handicapped accessible public toilet facility.

BACKGROUND OF THE INVENTION

Public, sidewalk pay toilets are a common sight in many European cities. The facilities are generally accepted and are considered an excellent way to meet the demand for accessible public toilets. The move in the United States to incorporate the toilets in the major metropolitan areas, on the other hand, has been slow at best. However, recently there has been efforts to find some form of answering the demand for accessible public toilets in the United States. Major cities such as New York and San Francisco have already begun or planned pilot projects with the sidewalk pay toilets.

The sidewalk public toilet is a facility which must be able to respond to a variety of demands and site restraints. The problem with present public toilets is that the sanitary units produced are relatively large and use too much precious sidewalk space. Many of the units (such as the unit disclosed in U.S. Pat. No. 4,301,558) are little more than small rooms installed on sidewalks. Generally, a section of a sidewalk, which may be narrow or already crowded, must accommodate a public toilet facility which is the size of small automobile. Some of the more creative designs for automatic public toilets (such as the sidewalk facilities in France designed to look like a kiosk) are not handicapped accessible, and are often still too large for a many sidewalk areas. This kiosk-type of design would not conform to the requirements of the Americans with Disabilities Act.

Often, prior art public toilet facilities use a porcelain or polyester toilet bowl that retracts into an equipment compartment for spraying and/or brushing. After the cleaning cycle, the toilet bowl and seat may have droplets of liquid on their surfaces. Although the bowl and seat were probably thoroughly disinfected, the liquid left on the bowl or seat gives the impression of uncleanness. Some of the newer facilities have dryers that blow on the seats and bowls, but these dryers are inefficient.

On some models the bowl itself is similar to a motorized bedpan and does not have a hole for immediate waste disposal. There is a need for a more aesthetically pleasing way of presenting the toilet bowl and seat and disinfecting the toilet bowl and seat. In addition, a need exists for a way of providing immediate waste disposal siphoning from the bowl.

Many of the larger sidewalk toilet units (such as the unit disclosed in U.S. Pat. No. 4,301,558) are divided into two volumes: one volume for users and an equal or larger sized volume for equipment and machinery. There is a need for a unit which more efficiently uses sidewalk space and which more compactly provides needed equipment and machinery.

Most prior art public, sidewalk toilets use prefabricated concrete for the user compartment and a weight sensing metal floor. This type of design gives many people the impression of walking into some kind of large urinal. This impression is reinforced by the humid condition of the interior after the cleaning cycle (such as the cleaning cycle disclosed in U.S. Pat. No. 4,301,558). Also, because of insufficient ventilation of the user compartment, odors have a tendency to linger. There is also a tendency, because of the closed-in nature of the devices, for garbage to accumulate in the user compartment. There is need for more sanitary public toilet facility which can overcome these problems.

The public toilet units that are being designed at the present time include integral concrete bases and walls and therefore are quite heavy. The units, therefore, are not easily movable to other sites if the need arises for a large number of the facilities to be assigned to a certain sector of a metropolitan area. Weight is not the only characteristic that makes the facilities difficult to reassign. Many times the utilities wiring and plumbing extend throughout the facilities and are not easily disconnected. Even if the utilities can be disconnected, there is no good way to cap the utility leads.

Because of the difficulty of reassigning the prior units to different locations, municipal governments are forced to use portable toilets which do not have immediate evacuation of waste or facilities for a lavatory. These portable toilet systems do not offer the hygiene that the sidewalk public rest rooms afford. The toilets also require regular service by pump trucks, which is not only inconvenient and labor intensive, but also puts the units out of service for a period of time. There is a need for a public toilet system in which the facilities are reassignable so they may be put in high traffic areas or event areas and can be designated to certain spots during different events or times of the year.

Another problem with prior public toilets is that they offer little privacy. When the door opens on the prior devices, anyone passing by sees the toilet and the person going into the unit. This tends to make the user self-conscious and embarrassed. At night when the door opens, the shiny toilet bowl is visible to all and a flood of lights spills out on the street announcing to everyone that the user is entering a public toilet. Although many Europeans are less concerned about such discretion, the idea of using a public rest room on the sidewalk in a major metropolitan area seems very foreign to most Americans. The large, utilitarian units offered in the past reinforce Americans phobia about toilets. A more attractive, less imposing design may increase acceptability of the facilities in the United States and ultimately determine their success or failure.

SUMMARY OF THE INVENTION

The present invention solves the above-mentioned problems by supplying an automatic, self-cleaning, handicapped accessible, public toilet facility. The facility includes a semicircular door which is stored behind the machinery and equipment compartment when the facility is unoccupied. Therefore, the facility is not a large room placed out on an open sidewalk, but instead is an open canopy when unoccupied, normally taking up only the semicircular foot print of the service module, or equipment compartment, on the side walk. The facility thus allows sidewalk pedestrian traffic a throughway when the facility is not in use. When someone enters the facility, the semicircular door closes, and the toilet fixture automatically comes down out of a vertical position to a horizontal position in the user compartment. Since the unit has removable modular components, on-site construction takes little time and maintenance costs are low.

The facility includes an automatic washing and drying system for the toilet and lavatory, provisions for the disabled, a panic button, a mirror, dispensers for toilet tissue, feminine accessories and condoms, and many other features afforded by indoor bathrooms. An illuminated poster is integral with the outside door, helping to curtail maintenance costs with advertising revenues. The translucent glass roof illuminates the interior during the day, and at night is visible as a luminous half-moon shape to viewers in the surrounding tall buildings.

More particularly described, the present invention provides a public toilet facility, the facility including a base portion with an uppermost peripheral horizontal surface set within a suitable anchor having a horizontal top surface and including a water supply line and waste disposal pipe. A floor slab having an upper surface is set within the base portion and an equipment and machinery compartment is removably attached to the base. The equipment and machinery compartment includes a detachable water line for attaching to the water supply line and a detachable waste disposal line for attaching to the waste disposal pipe. A toilet is included in the machinery compartment along a first side of the compartment, the toilet being connected to the detachable water supply line and the detachable waste disposal line. A removable door is included which is operatively associated with the equipment and machinery compartment. The door is operated from a first position where the first side of the equipment and machinery compartment is exposed to a second position to form an enclosure with the equipment and machinery compartment. When the enclosure is formed, the first side is contained within the enclosure and the toilet is accessible within the enclosure. The door is configured such that the door may be removed along with the equipment and machinery compartment.

Preferably, the anchor is a sidewalk and the base portion and the floor slab are mounted flush with the sidewalk. It is possible to have the base configured such that it may receive a utility slab upon removal of the compartment. In such a circumstance, the utility slab and floor slab preferably form a complete cover for the base when the equipment and machinery compartment is removed.

The present invention also provides a facility capable of first and second configurations. The facility includes a floor defining an outer circumference having a first and second length. An equipment and machinery compartment having a toilet and defining a first wall which extends vertically from the first length of the circumference of the floor is also provided for the facility. A roof is connected to the equipment and machinery compartment and is designed to cover a vertical projection of the floor. A movable door is operatively associated with the floor and the compartment such that in a first configuration of the facility, the door is substantially removed from the second length of the circumference of the floor such that the floor and the vertical projection of the floor are bolted substantially only along the first length by the first wall defined by the compartment. In a second configuration, the door is moved such that it forms a second wall about the second length of the circumference of the floor, the second wall, the first wall, the roof, and the floor forming an enclosure whereby the toilet may be accessed within the enclosure when the facility is in the second configuration.

Preferably, the equipment and machinery compartment has a cross-sectional area which is crescent-shaped.

The present invention further provides a public toilet facility, the facility including a compartment and a motor within the compartment. A gear is operatively connected to the motor and a control unit for controlling the operation of the motor is connected by electrical circuit to the motor. A toilet comprising a toilet bowl rotatably mounted on a vertical rack and operatively connected to the gear is provided within the compartment. A lavatory comprising a wash basin is also provided within the compartment, and the toilet bowl is stored below the wash basin in an upright, vertical position in a first configuration. The gear, the motor, and the toilet bowl are configured such that once the control unit is engaged, the bowl rotates along a rotational axis to a horizontal position and then raises along the vertical rack to a predetermined height.

Therefore, an object of the present invention to provide an improved public toilet facility.

It is a further object for the present invention to provide a public toilet facility which takes up little sidewalk space.

A further object of the present invention is to provide a public toilet facility which uses less public space when not in use.

Still another object of the present invention is to create a public toilet facility which is handicapped accessible.

Yet another object of the present invention is to create a public toilet facility which has automated cleaning.

A further object of the of the present invention is to provide a toilet bowl for a public toilet facility which is self cleaning and which not only is cleaned but appears to be sanitary after the wash.

Another object of the present invention is to provide a public toilet bowl which offers continual waste disposal.

Still another object of the present invention is to provide a public toilet facility which is capable of reassignment such that the public toilet facility may be transported to high pedestrian traffic areas or event areas in a metropolitan environment.

Further objects, features, and advantages of the present invention will become apparent upon consideration of the following detail description of the invention, when taken in conjunction with the drawing and the appended claims.

DETAILED DESCRIPTION OF THE INVENTION

Figure 1:
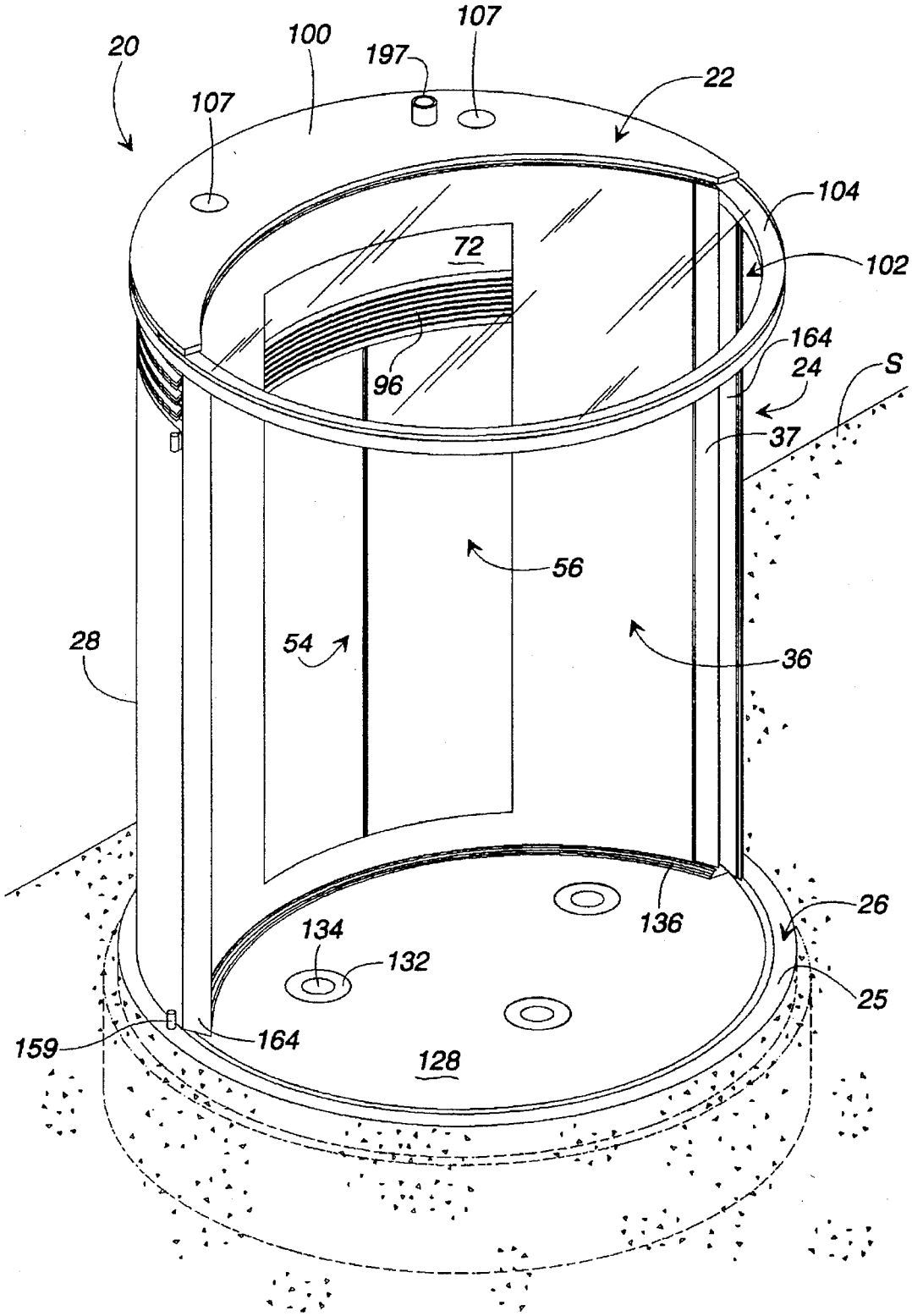
FIG. 1 is a perspective view of a public toilet facility embodying the present invention with the facility being in a "stand ready" configuration.
Figure 2:
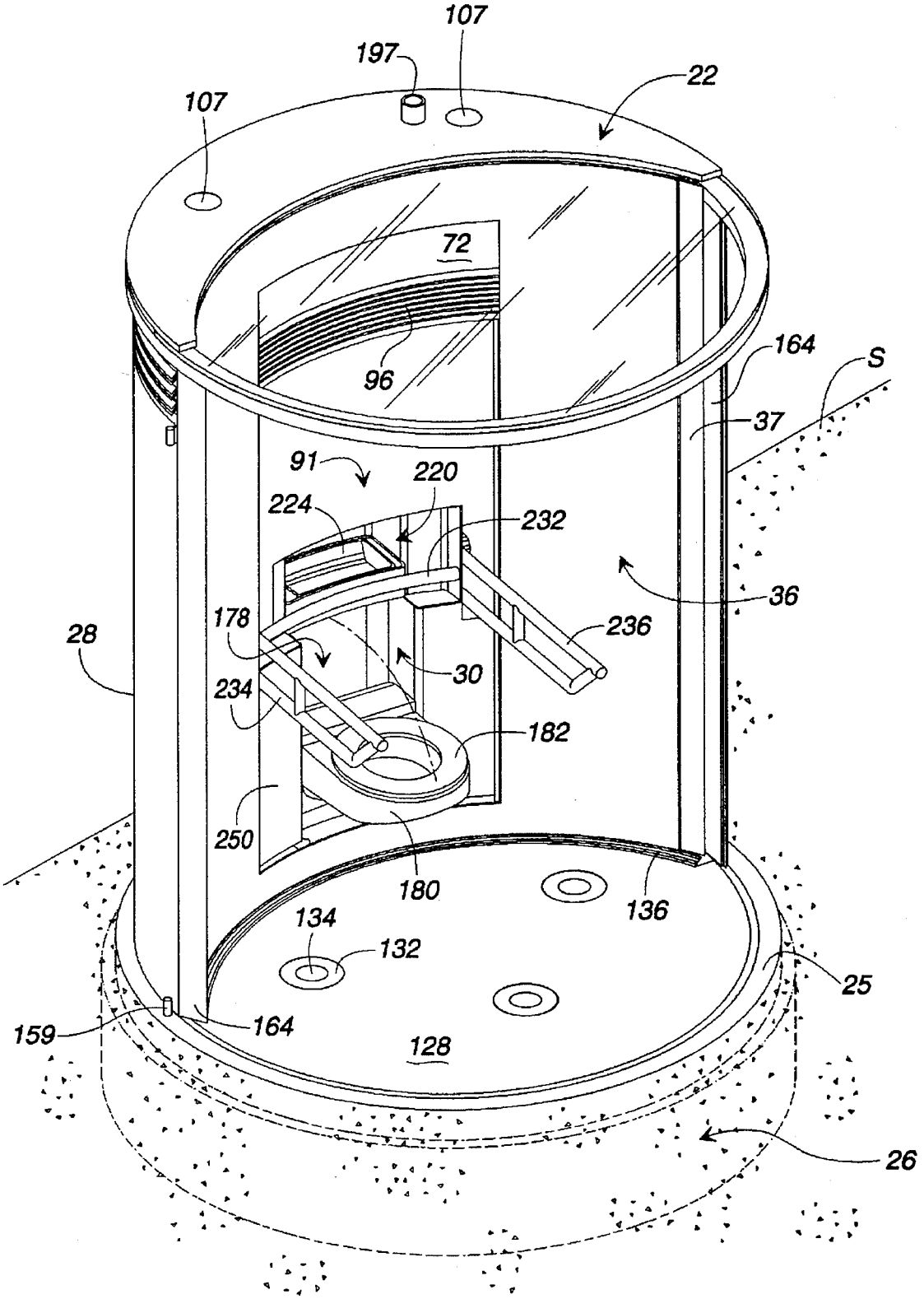
FIG. 2 is a perspective view of the facility of FIG. 1, with the toilet bowl and grab bars deployed and the semicircular door in the retracted position to show the interior.
Figure 3:
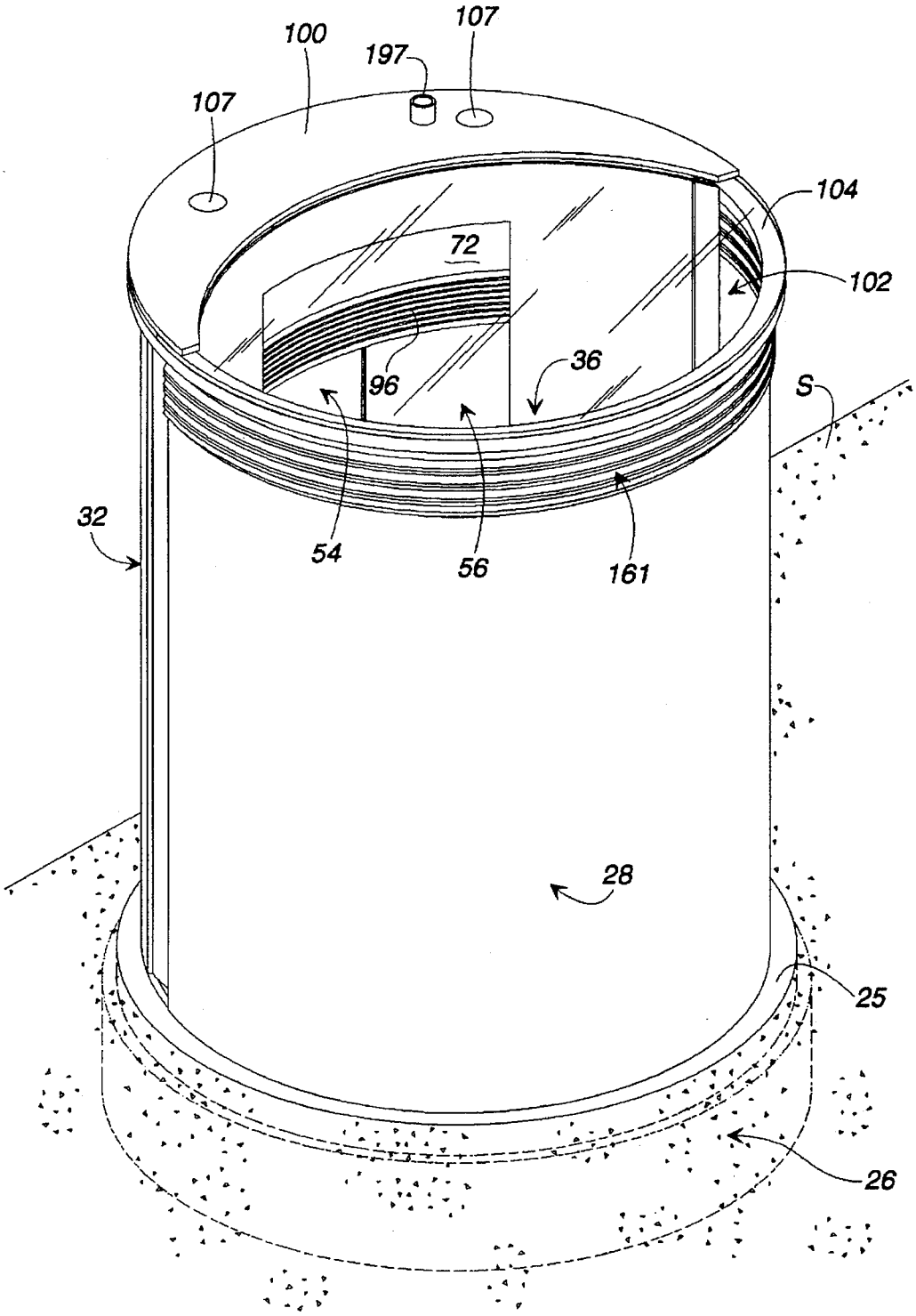
FIG. 3 is a perspective view of the facility of FIG. 1, with the semicircular door in the "in use" configuration.

Turning now to the drawing, in which like reference numerals represent like parts throughout the several views, FIG. 1 discloses an automatic, self-cleaning, handicapped accessible, public toilet facility 20 embodying the present invention. The facility 20 shown in FIG. 1 includes a roof 22, an elongate equipment and machinery compartment 24, and a base or base portion 26 having an uppermost peripheral horizontal surface 25. As shown in a first configuration in FIG. 1, a rotatable, semicircular door 28 extends around and behind the compartment 24. Briefly described, the facility 20 is configured such that when operated, the rotatable, semicircular door 28 revolves around the base 26 such that an enclosure is formed (see FIG. 3), and a toilet drops down out of a toilet compartment 30 and is accessible to a user in the compartment (see FIG. 2).

Figure 4:
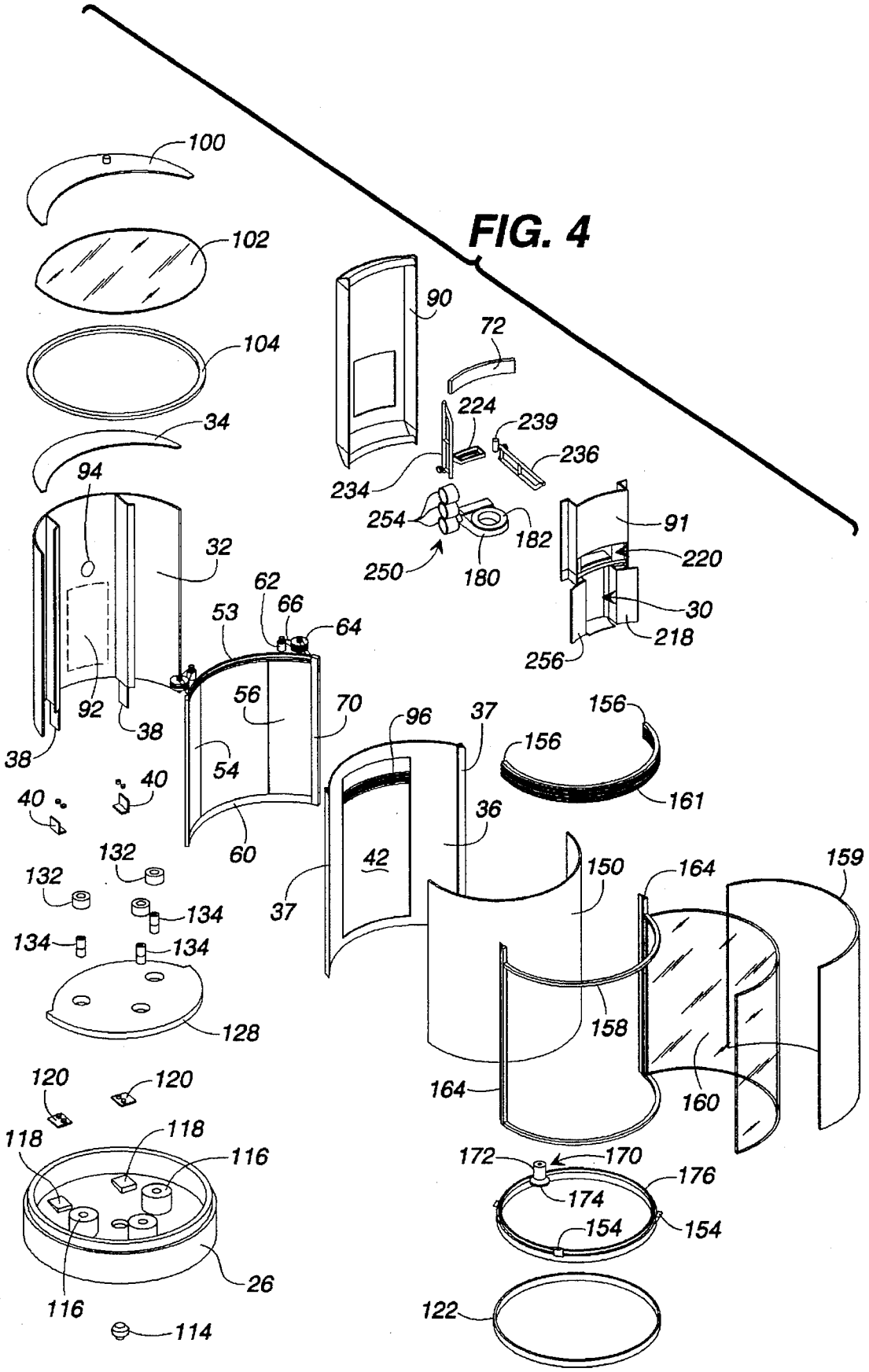
FIG. 4 is an exploded perspective view of the facility of FIG. 1.

As can be seen in FIG. 4, the equipment and machinery compartment 24 is defined by a rounded back panel 32, a top plate 34, and a front panel 36. The curvature of the panels 32, 36, gives a horizontal cross section of the compartment 24 a crescent shape. Preferably, the rounded back panel 32 serves as the structural support for the rest of the panels and plates of the equipment and machinery compartment 24. Therefore, the back panel 32 is a thickened (such as one inch) steel or aluminum, and the other panels and plates of the equipment and machinery compartment 24 are of a much thinner steel or aluminum. The front panel 36 preferably includes two rubber ends 37, which serve to cushion collisions. Two support beams 38 extend between and are attached by welding or bolts (not shown) to the rear panel 32 the front panel 36. Alternatively, the support beams 38 are extruded and are integral with the panel 32. The bottom ends of the support beams 38 are attached by means of bolts or other suitable fasteners (not shown) to angles 40, which in turn are connected to the base 26.

The front panel 36 includes an opening 42 extending along its center portion. The front panel 36 is attached along its side edges to the side edges of the back panel 32 and is connected along the top portion, above the opening 42, to the support beams 38. The opening 42 is preferably a width that matches the distance between the two support beams 38. Along the top edge of the opening 42 on the back side of the front panel 36 is located a top channel 50 (see FIG. 16).

A set of double sliding doors 54, 56 are designed for being received behind the opening 42 and the panel 36. The sliding doors 54, 56 fit between the front panel 36 and the back panel 32 and are preferably stainless steel sheets fitted with gaskets (not shown) and set for sliding movement within top and bottom horizontal guide rails 58, 60. Movement of the doors 54, 56 is made possible by a drive system including a motor 62, a pulley 64 with an actuating arm, drive belts 66, and an electronic motor revolution counting sensor (not shown). Such drive systems are customary in garage door openers and elevators, and are known to one skilled in the art. Vertical structural members 70 are supplied for holding the horizontal guide bars 58, 60 the proper distance apart. The entire assembly of the sliding doors 54, 56, the vertical structure members 70, and the horizontal guide bars 58, 60 are attached to the front, leading edges of the back panel 32 and the support beams 38. As can best be seen in FIG. 1, the doors 54, 56, when closed, along with the front panel 36, form the front side of the compartment 24.

Figure 13:
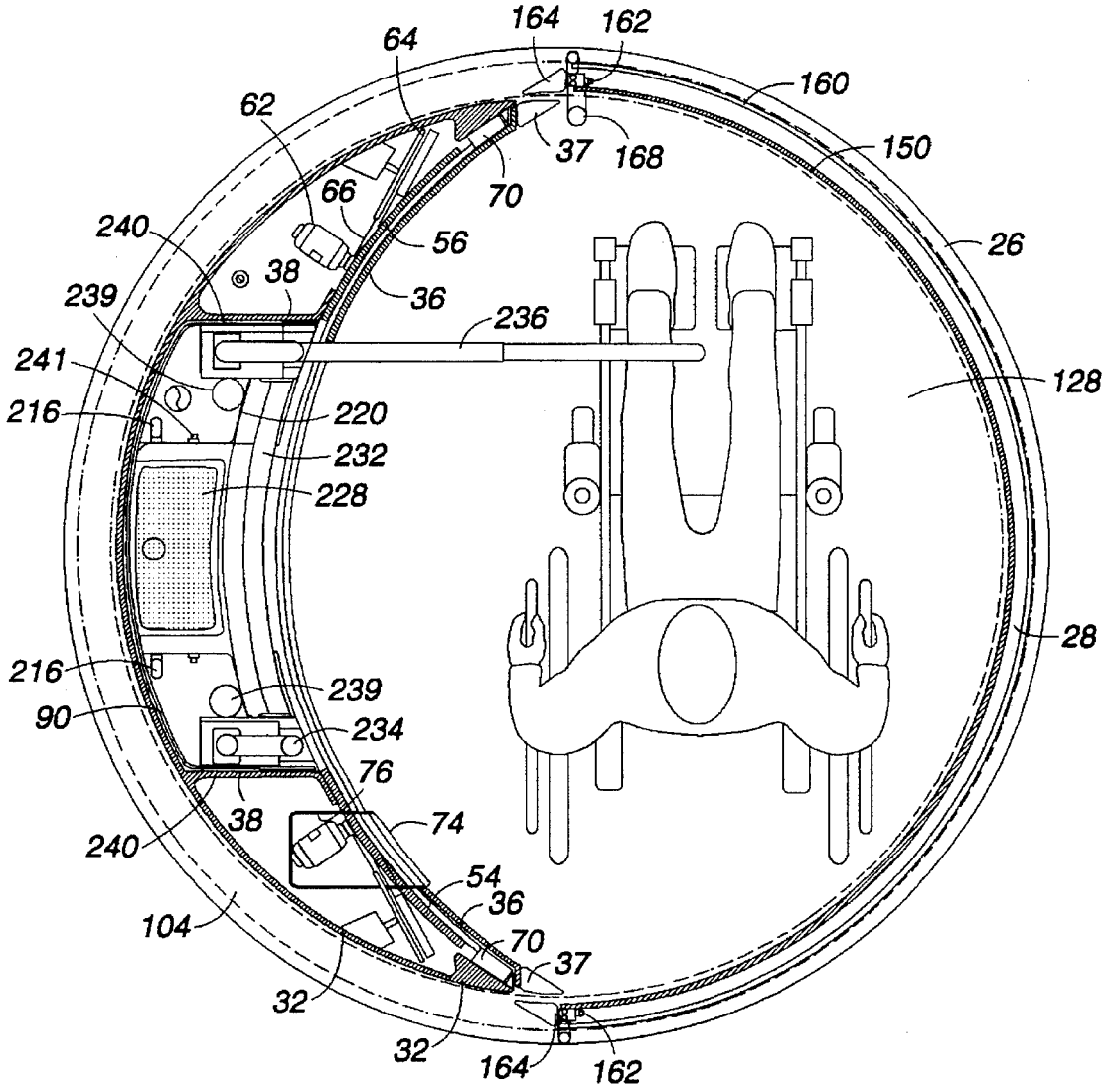
FIG. 13 is a cutaway view of the facility of FIG. 1, taken along the section line 13—13 of FIG. 12.
Figure 14:
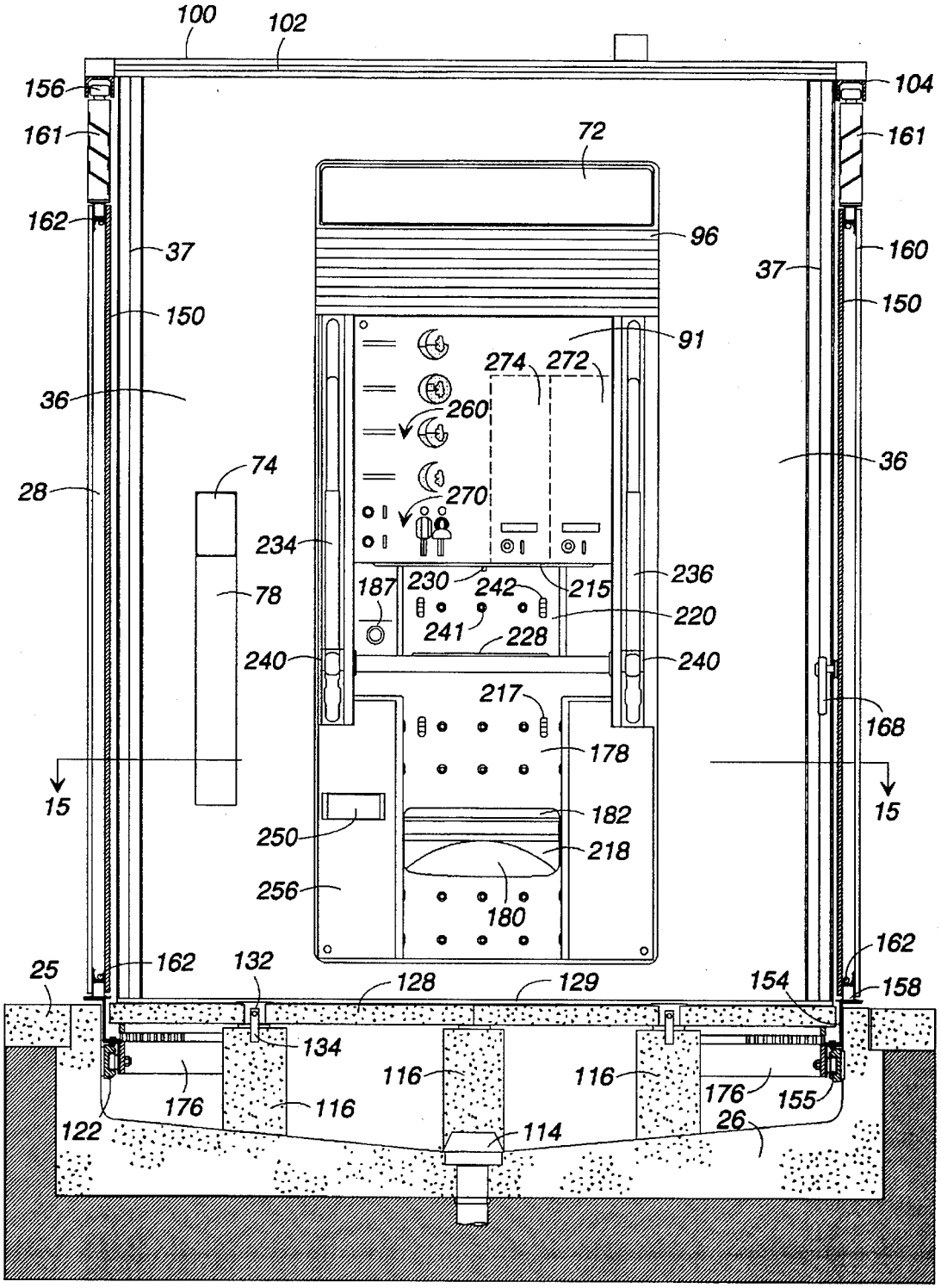
FIG. 14 is a front view of the equipment and machinery compartment of the facility of FIG. 1, with the double sliding doors in the opened position, and the toilet bowl in the horizontal position.
Figure 15:
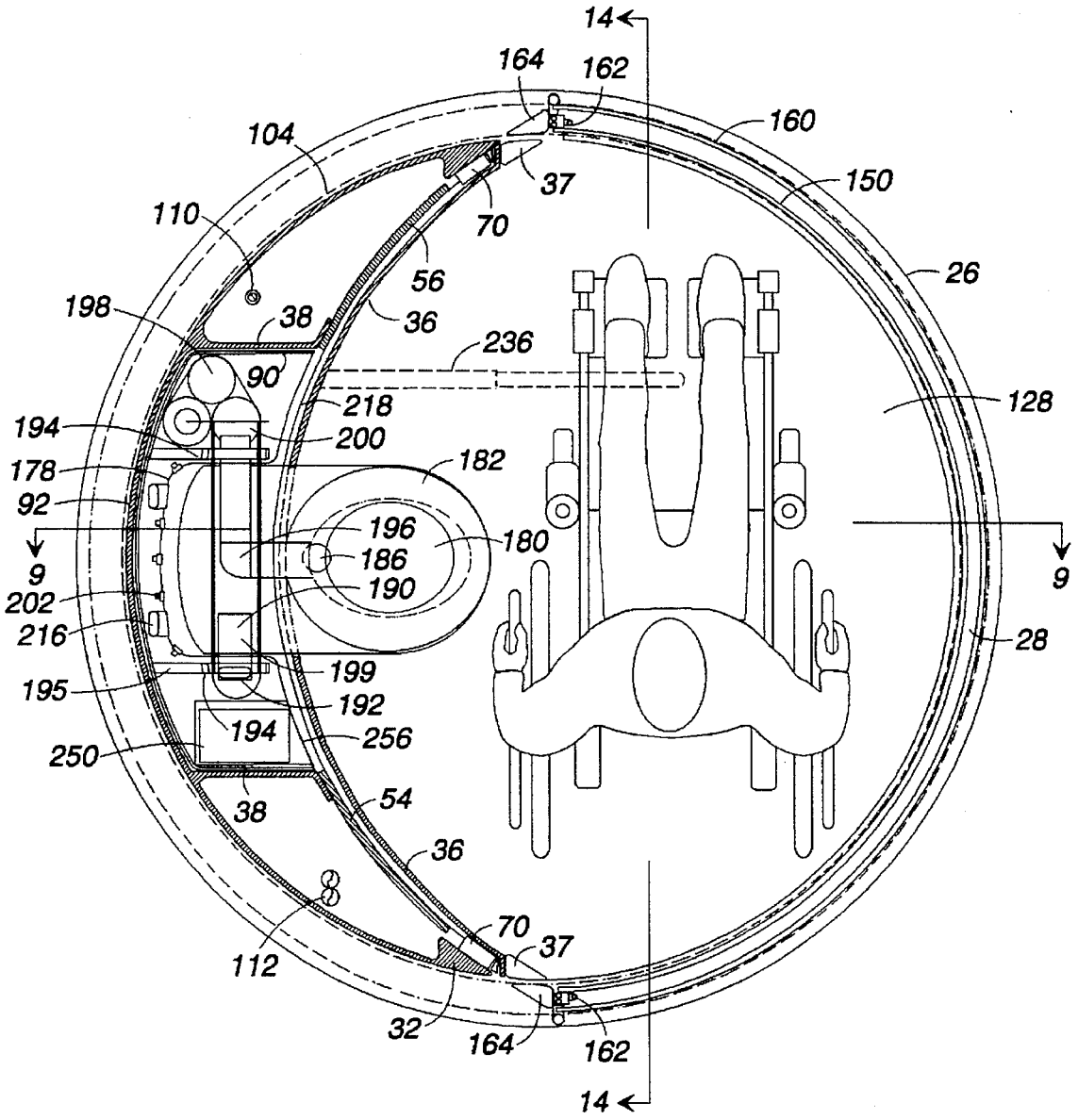
FIG. 15 is a cutaway view of the facility of FIG. 1, taken along the section line 15—15 of FIG. 14.

Preferably, a light fixture 72 is included along the top of the panel 36. In addition, an opening 74 (see FIG. 7) is provided in the left hand side of the front panel 36 for accessing a garbage receptacle 76 (see FIG. 13), which is contained within the compartment 24 between the back panel 32 and the front panel 36. An access panel 78 is supplied on the front panel 36, just below the opening 74, which serves as a passageway for a maintenance worker to remove trash from the receptacle 76.

As can best be understood with reference to FIG. 4, the equipment and machinery compartment 24 includes a frame 90 which is suspended between the support beams 38 within the opening 42 and extends the length of the back panel 32. The frame 90 houses the majority of the internal components suspended within the equipment and machinery compartment 24. Access is available to the equipment and machinery compartment 24 when the two sliding doors 54, 56 are open. In addition, a maintenance access panel 92 is located on the back panel 32 which allows additional access to the back side of the frame 90. Ventilation louvers 94, 96 are located midway up the back panel 32 and along the top side of the front panel 36, respectively, for supplying ventilation to the frame 90 and the components therein.

Figure 8:
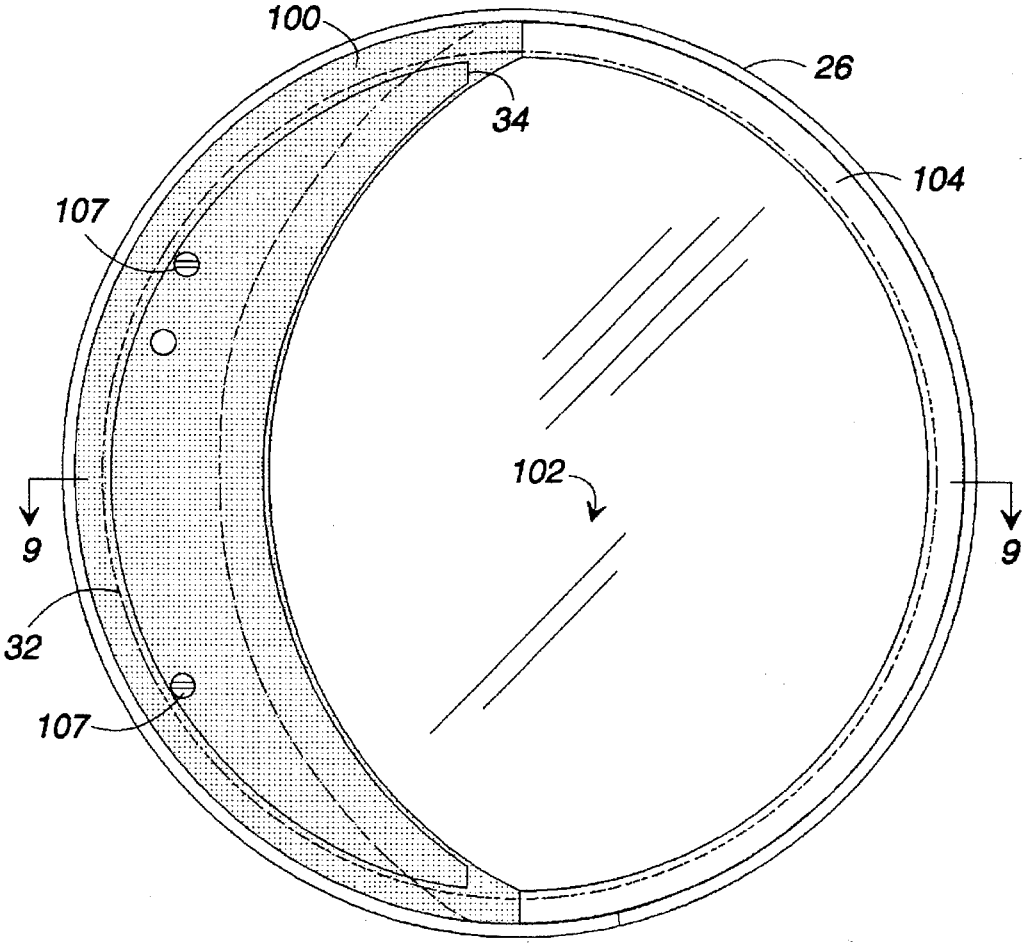
FIG. 8 is a top view of the facility of FIG. 1.
Figure 16:
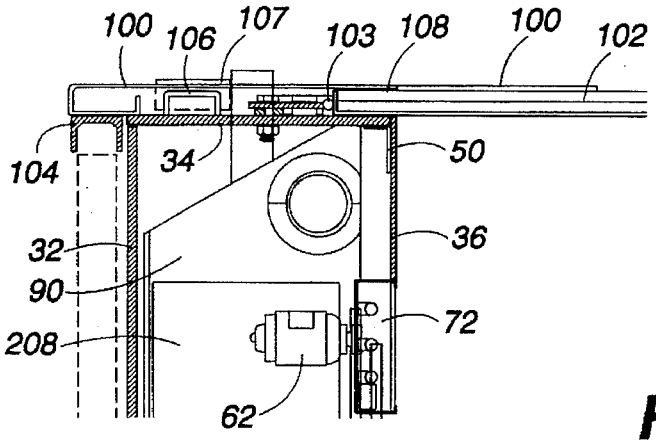
FIG. 16 is a cutaway view of the roof attachment of the facility of FIG. 1.

Turning now to FIGS. 8 and 16, with continuing reference to FIG. 4, the roof 22 is a circular structure that includes a metal cover plate 100 and a horizontal panel 102. Preferably, the horizontal panel 102 is translucent. The panel 102 may be two layers of an acrylic or two layers of glass laminated for safety and translucence. If glass or acrylic is chosen, a translucent film may be inserted therebetween, or one side of one the pieces may be sandblasted. The edges of the panel 102 are exposed to view when the facility 20 is fully constructed, and therefore may be slightly chamfered to offer an aesthetically pleasing surface.

An elongate light fixture 103 (see FIGS. 9 and 16) is located in close proximity to the edges of the panel 102 under the metal cover plate 100 to achieve a fiber optic effect on the visible horizontal edges of the panel 102. A metal ring 104 acts as the frame support for the roof 22 and is attached to the perimeter of the panel 102. The ring 104 is a "c" type metal channel along its bottom side which acts its a top guide rail for the semicircular door 28, as will be discussed in detail below. A metal flange 108 is included for holding the panel 102 in place. Lifting rings 106 are provided along the top side of the metal cover plate 100. The lifting rings 106 are attached to the top plate 34 and, as described in detail below, serve as the attachment points for lifting the entire assembled facility 20, except for the base 26, into position to be installed. Covers 107 are provided for the rings 106 when they are not in use.

To construct the roof 22, the horizontal panel 102 is fitted to the metal ring 104 so that it is held in place. The ring is then bolted or suitably attached to the top plate 34, and, once the panel 102 is in place, the flange 108 is bolted or attached in a suitable fashion to the structural top plate 34. By bolting these elements together, support is given for the rest of the metal ring 104 and horizontal panel 102 such that the horizontal panel 102 and the "c" type metal channel 104 are suspended in position. The metal cover plate 100 and light fixture 103 are then attached to the top plate 34.

Turning now to FIGS. 5, 6, 7, 9, and 17, the base 26 is a prefabricated circular concrete form which includes connections 110, 112, for plumbing and electricity, respectively. The base 26 is equipped with a storm water drain 114 and concrete circular support pedestals 116, the function of which will be described below. Support pedestals 118 (see FIG. 4) are also provided for supporting the compartment 24, and support plates 120 are affixed and placed on these pedestals. A guide rail 122 is provided for attachment to the semicircular door 28. The guide rail 122 is attached to the base 26 with bolts which extend through the rail into the base.

Figure 5:
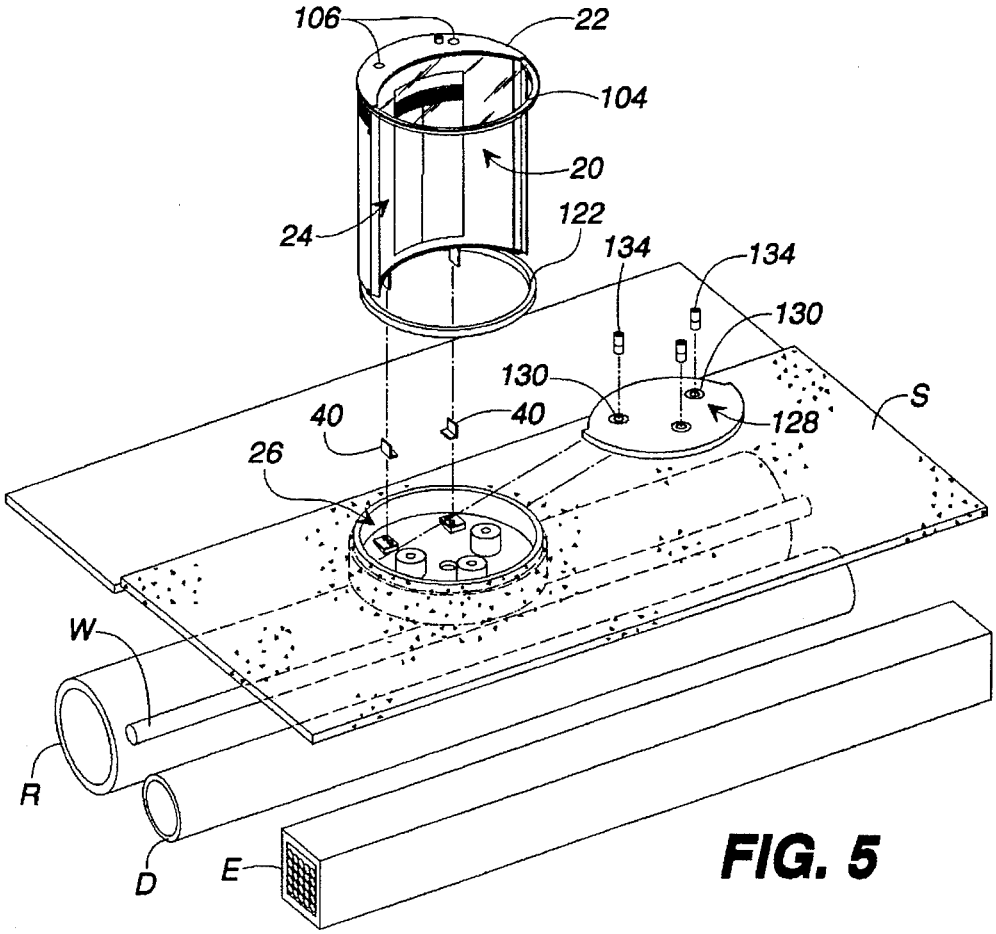
FIG. 5 is an exploded perspective view of the facility of FIG. 1 in a stage of installation, with the base mounted in a sidewalk.

A floor slab 128 having an upper surface 129 is used as a partial covering for the base 26. The floor slab 128 is preferably made of glass fiber-reinforced concrete. During installation (as shown in FIG. 5) the floor slab 128 is suspended over the base 26 by lifting plugs 130. Once the slab 128 is installed in the base 26, the plugs 130 are removed and the slab is leveled by a series of leveling pins 132. Leveling plugs 134 are used to cover the holes left by the leveling pins 132 and lifting plugs 130. A grill 136 is provided on the edge of the slab 128 for drainage. The floor slab 128 preferably includes an electrical resistant heating element (not shown) to prevent ice or snow from accumulating on the surface, blocking the passage of the. semicircular door 28, or accumulating between the edge of slab 128 and base 26.

As can be seen in FIG. 5, the base 26 is mounted beneath a sidewalk S such that the upper edge or uppermost peripheral horizontal surface 25 of the base is level with the horizontal top surface of the sidewalk. Beneath the sidewalk S extends city services of electricity and phone E, sewage drainings D, storm drainage R, and water supply W. When fully in position, the base 26 is connected (not shown) to each of the services E, D, R, and W. Each of the services has a quick-disconnect type connection for attachment to the compartment 24.

Figure 6:
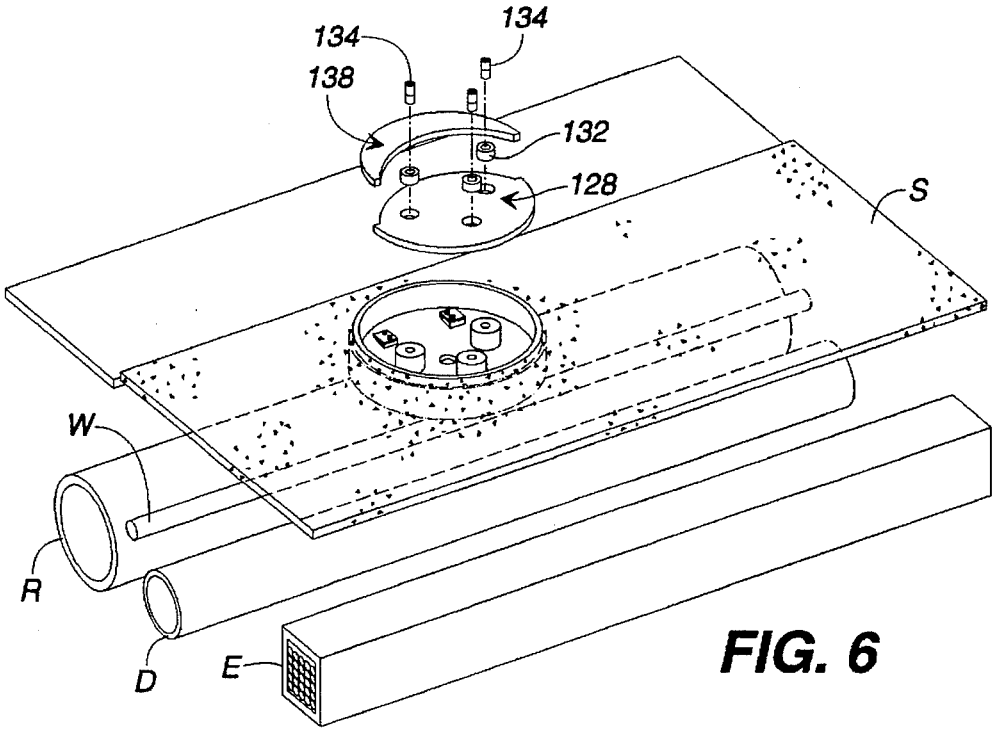
FIG. 6 is an exploded perspective view of the base of the facility of FIG. 1, with a utilities slab present to fill the void where the rest of the facility, is mounted.

The upper surface 129 of the floor slab 128 is mounted level with the horizontal top surfaces of the sidewalk when it is properly positioned within the base 26. As can be seen in FIG. 6, when the compartment 24 is not in place on the base 26, a utilities cover slab 138 may be used to cover the portion of the base 26 which is not covered by the floor slab 128. The utilities cover slab 138 fits against the floor slab 128 to complete the circular form of the base 26, and to create a level, flat surface which is even with the sidewalk. The utilities cover slab 138 is equipped with lifting plugs (not shown, but similar to that provided for the floor slab 138) for suspending the slab above the base 26. Leveling pins (not shown, but similar to that provided for the floor slab 138) are provided for correct placement of the slab 138 and are fitted with plugs (not shown, but similar to that provided for the floor slab 138).

The semicircular door 28 includes several components which allow a door panel 150 (see FIG. 4) to slide along both the upper "c" channel within the ring 104 and the lower, channeled guide rail 122. In a first or "stand-ready " position, as is shown in FIG. 1, the semicircular door 28 extends behind the compartment 24. However, the semicircular door 28 may be activated so that it may move along the "c" channel and the guide rail 122 to a second configuration, or an "in-use" configuration. In this second or "in use" configuration, the semicircular door 28, the compartment 24, the roof assembly 22, and the base 26 form an enclosure (see FIG. 3).

Figure 11:
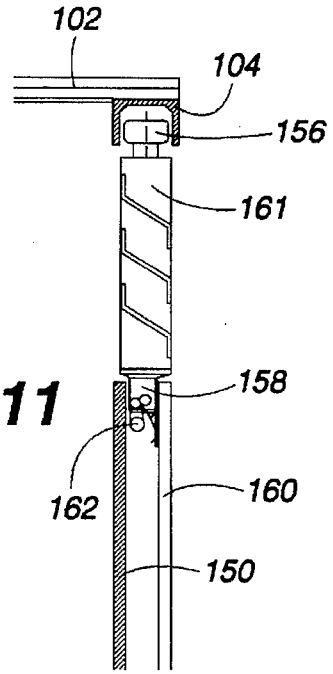
FIG. 11 is a cutaway view of the top portion of the semicircular door for use in the facility of FIG. 1.
Figure 17:
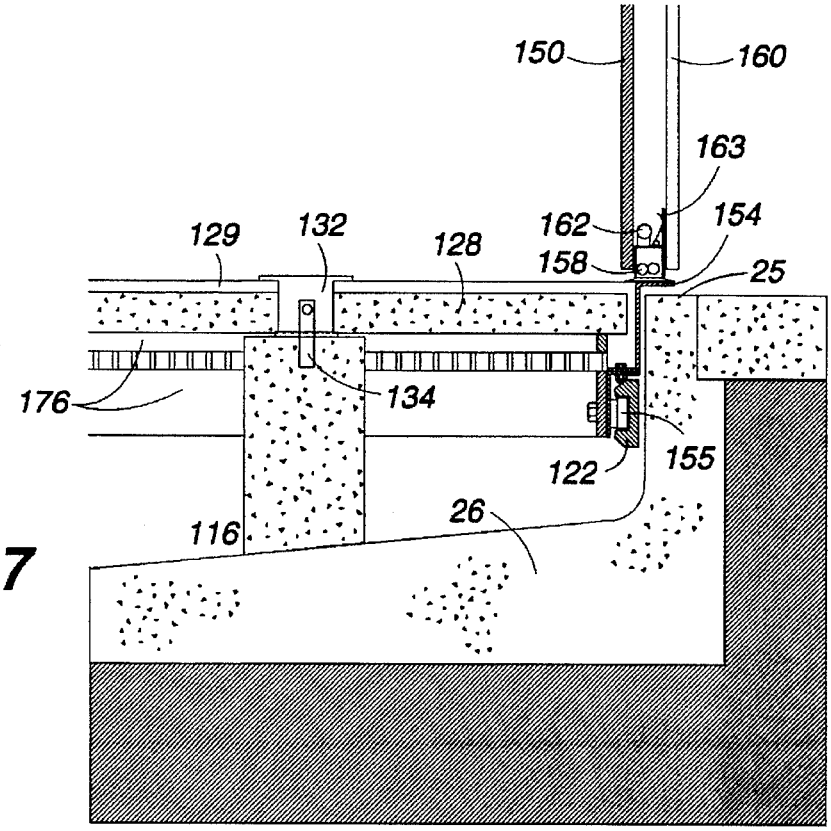
FIG. 17 is a cutaway view of the bottom portion of the semicircular door for use in the facility of FIG. 1.

As can best be understood with reference to FIG. 17, the door 28 includes at its lower end Z-shaped brackets 154 leading to wheels 155 which engage the channeled guide rail 122. As is shown in FIG. 11, the upper end of the door 28 includes guide wheels 156 which extend inside the "c" channel 104. A metal frame 158 (see FIG. 4) extends around the perimeter of the semicircular door 28. The frame 158 supports the door panel 150 and an advertising panel 160. The frame 158 preferably includes a metal ventilation louver 161 along its upper length to aid in circulation of air throughout the enclosure when the door 28 is in the "in-use" position.

The advertising panel 160 may be made of transparent glass or acrylic and is attached to the frame 158 by hinges or other suitable fasteners. An advertising poster 159 (see FIG. 4) is installed along the inner side of the advertising panel 160. The advertising panel 160 serves an aesthetic purpose as well as the primary source of income for the facility 20. Four elongate light fixtures 162 (see FIGS. 9, 11, 17 and 13) may be provided between the door panel 150 and the advertising panel 160 such that the advertising panel may be illuminated. Wiring (not shown) for the light fixtures 162 may pass inside the hollow tubes of the door frame 158, and is supplied electricity throughout its complete range of motion by an armored cable (not shown) which passes along one of the "Z" brackets 154 to a flexible cable (not shown).

Figure 7:
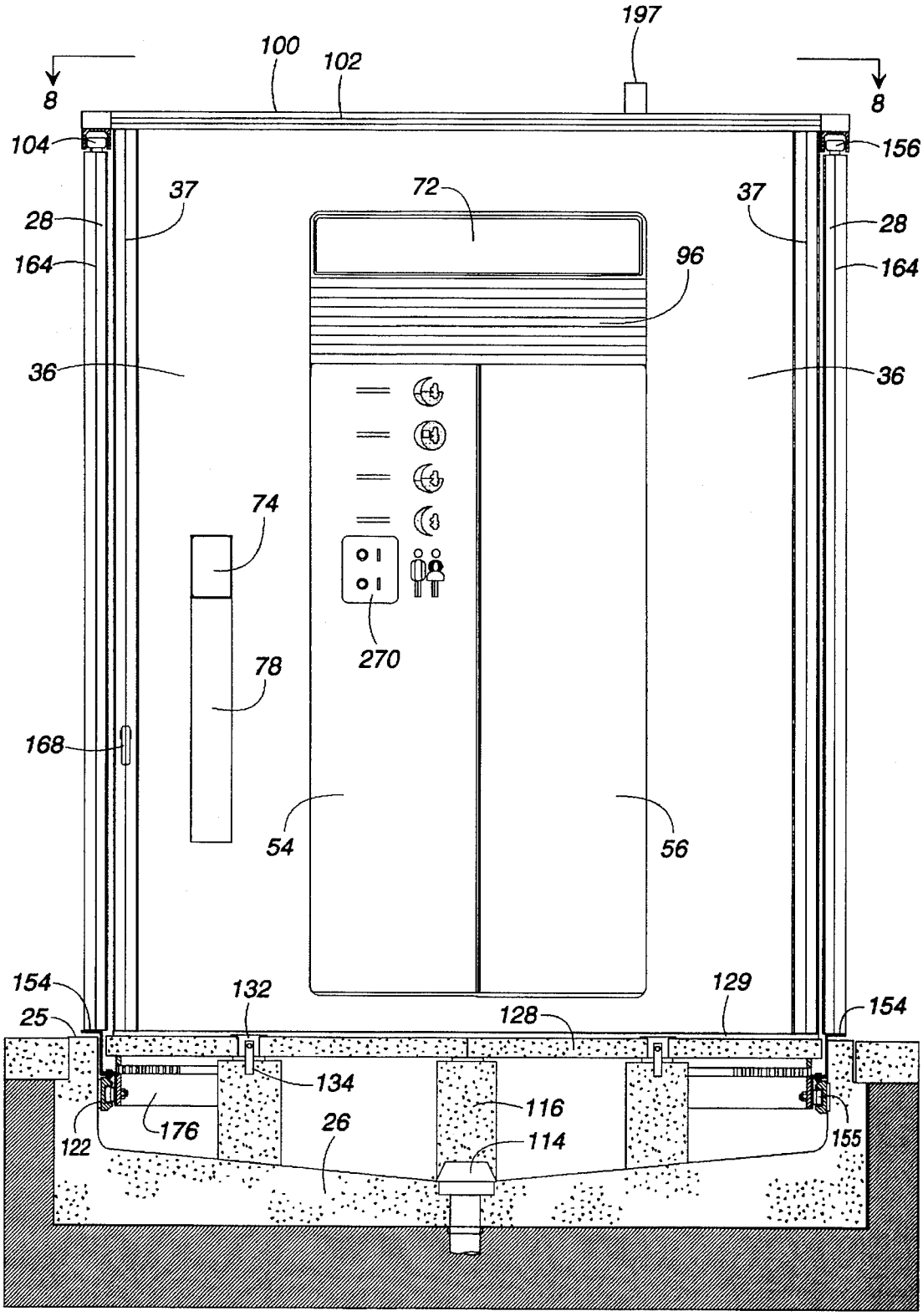
FIG. 7 is a front view of the equipment and machinery compartment of the facility of FIG. 1 with the facility in a stand ready position and, with the double sliding doors in the closed position and the semicircular door in a retracted position.
Figure 9:
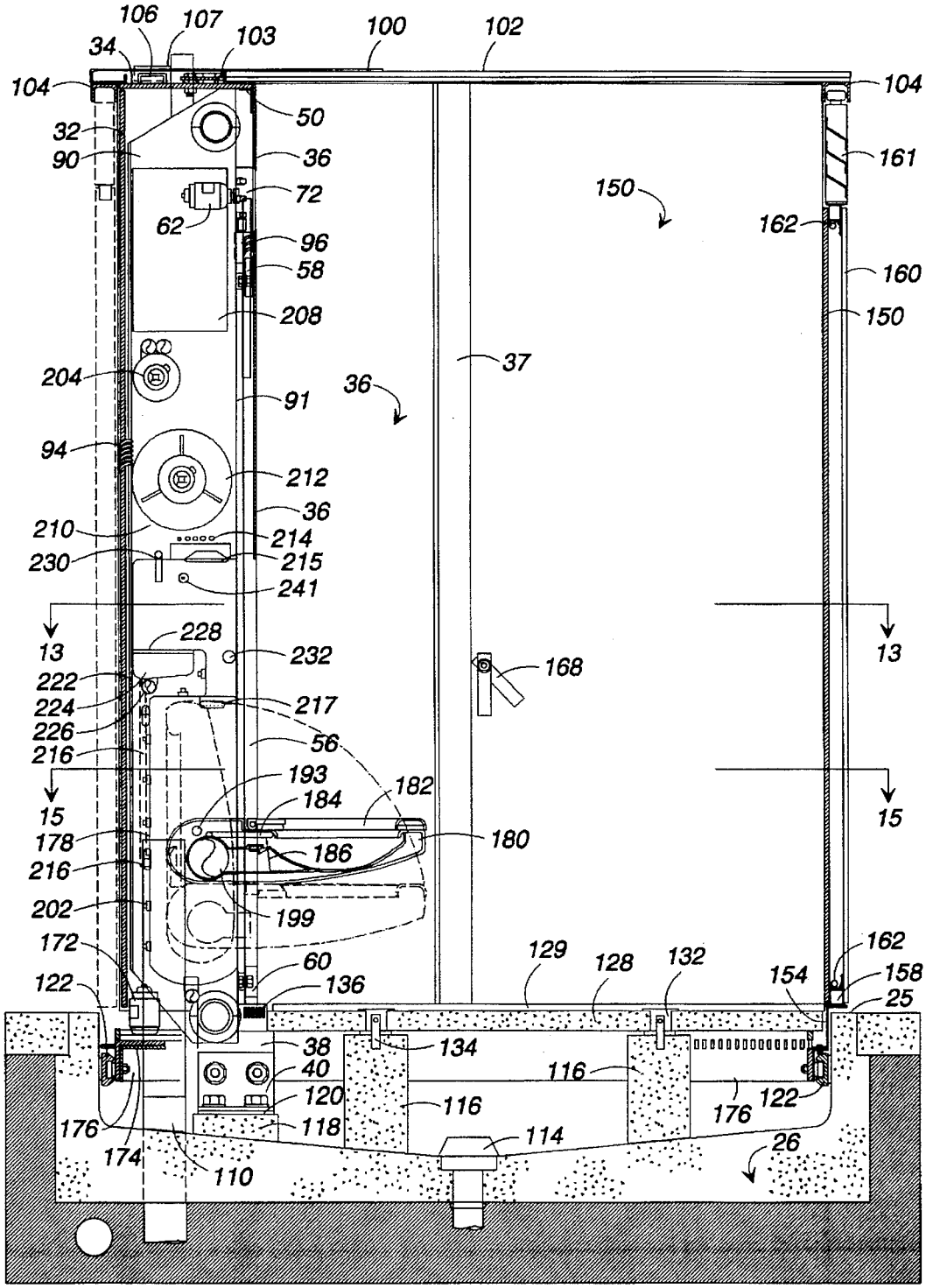
FIG. 9 is a cutaway view of the facility of FIG. 1, taken along the section line 9—9 of FIG. 8.

As shown in FIGS. 7 and 9, the semicircular door 28 preferably includes rubber ends 164 so that the door properly aligns with the side edges of the enclosure 24 when the door is in the "in use" position. In addition, the rubber ends 164 provide protection from collisions with the door 28 when the door is moving from the "stand ready" position to the "in use" position. The inner portion of the door panel 150 may include fittings for a mirror (not shown) and coat hooks (not shown). A door handle 168 is provided at the leading edge of the door panel 150.

The semicircular door 28 is activated by a motor control assembly (not shown) with a revolution counting sensor. This motor control assembly includes a motor 172 which activates a sprocket type drive 174 which rotates a drive ring 176 that moves the door 28 along with the door panel 150 along the guide rails 104 and 122. This motor control assembly is also similar to driving systems used with garage door openers and elevators. The rubber ends 164 may include pneumatic sensors (not shown), infrared sensors, or other suitable sensors, such that once a collision with the leading rubber end occurs, the movement of the door 28 will be stopped or reversed. Such sensors are used in conventional elevators and elevator doors.

Returning now to FIG. 5, it can be seen that once the base 26 is installed in a sidewalk S or other application area, the rest of the facility 20 (the compartment 24 along with the roof 22) may be easily installed or removed from the base. Removal is accomplished by first removing the floor slab 128, disconnecting the guide rail 122 from the base 26, unhooking and capping the utilities and plumbing leads, and then disconnecting the compartment 24 from the base 26. The compartment 24 and roof 22 may then be raised from the lift rings 106. The rail 122 is removed with the compartment 24, so that the door 28 remains in the upper guide rail 104 when the compartment 24 and the roof 22 are moved. A lockout apparatus (not shown) is used to stabilize rotation of the semicircular door 28 and the guide rail 122, and to hold the semicircular door in position with respect to the roof 22 and compartment 24.

Figure 10:
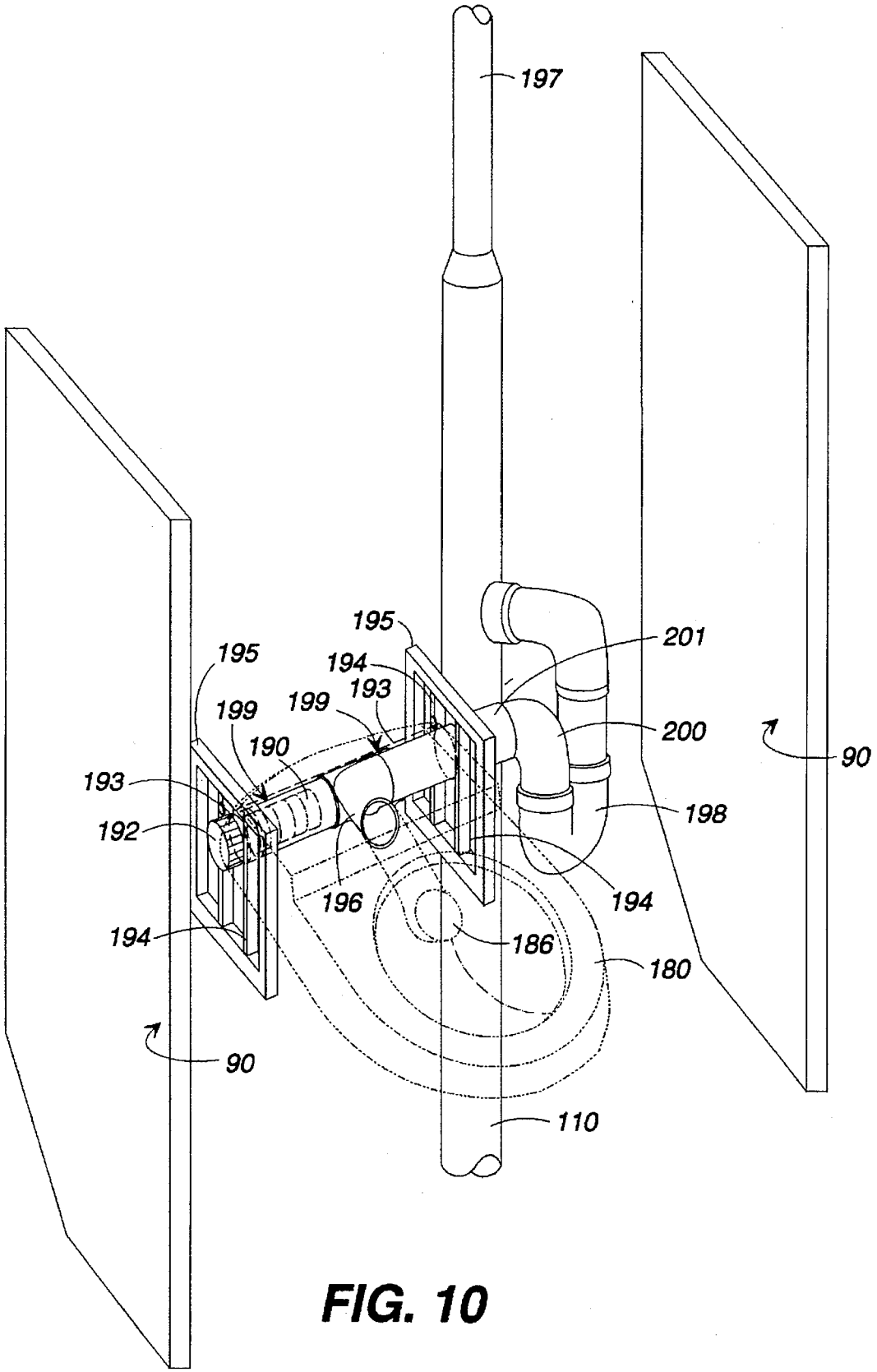
FIG. 10 is a perspective view of the toilet bowl assembly and corresponding vent and soil piping for the facility of FIG. 1.

The frame 90 includes several different components that can be accessed when the sliding doors 54, 56 are in the open position. The first of these components is the toilet compartment 30. The outer portion of the toilet compartment 30 defines a housing 178 including a drain (not shown) at its lower end leading to a trap (not shown). A metal or polyester toilet bowl 180 having a toilet seat 182 is contained within the housing 178 when the toilet bowl 180 is in a vertical position. As can be seen in FIGS. 9 and 10, the toilet compartment 30 includes a flushing water supply pipe 184 and a spring action drain clapper 186. The clapper 186 is of the variety found in airplane toilets or trains.

As can be understood from the following description, the toilet compartment 30 is designed such that the toilet bowl 180 is stored in an upward, or vertical, position when the sliding doors 54, 56 are closed. The toilet bowl 180 may then be lowered to a horizontal position, manually or automatically, when the sliding doors 54, 56 are opened. In addition, the present invention provides for vertical height adjustment of the toilet bowl 180 when it is in the horizontal orientation. This vertical height adjustment moves the toilet bowl 180 and toilet seat 182 to a level which meets handicapped requirements. Depressing button 187 causes the toilet bowl 180 to lower to the horizontal, and then raise vertically to the required height.

An electronic motor control unit (not shown) with a revolution counting sensor (not shown) is provided for lowering the toilet bowl 180 and toilet seat 182 into the horizontal position. The motor control unit is connected to a motor 190 (see FIG. 10) which activates a gear box 192. The gear box 192 and the motor 190 are preferably contained within one side of the toilet bowl 180. Mounted on the outside of the other side of the bowl 180 is a worm gear (not shown) which moves synchronously with the gear 192 and, along with a synchronized leveling device 193, allows the toilet bowl to move up and down guide rails 194 in a level manner. The device 193, by means of an axle and suitable gearing mechanism, prevents binding of the toilet bowl 180 on the guide rails 194. The device 192 is attached to a chassis 195 that carries the load of the entire toilet assembly and is attached to the frame 90.

The motor 190 and the gearbox 192 are located in a pipe housing 199, which in turn is located along the rotational axis of the toilet bowl 180. Extending out the other side of the housing 199 is the trap system, water system, and electronic system for the toilet. The trap system of the toilet compartment 30 includes a flexible connector 196 which extends from the bowl 180 out of the axis of rotation of the toilet on the side of the housing 199 opposite the motor 190. The flexible connector 196 extends downward into a fixed trap 198 leading to the sewage drainage D for the city and having a vent 197 at its top. The connection between the flexible connector 196 and the trap 198 is made by a slip coupling 200 and a flexible soil connector 201. The flexible connectors 196, 201 and the slip coupling 200 accommodate both the rotation and the vertical movement of the toilet bowl 180. The water supply pipe 184 and any electrical wiring (not shown) for sensors in the toilet bowl 180 have flexible connectors (not shown) that accommodate the movement of the water supply pipe around the toilet bowl 180.

As can be understood from the foregoing, the toilet compartment 30 is designed such that the toilet bowl 180 is stored in an upward position when the sliding doors 54, 56 are closed. Once the sliding doors 54, 56 are opened, the toilet bowl 180 automatically rotates to the horizontal position. In the same smooth movement, the vertical height of the toilet bowl 180 is adjusted to meet handicapped requirements. The button 187 provides a manual way of deploying or retracting the toilet bowl 180 for handicapped users or a parent with a child to allow the users to maneuver more freely within the enclosure.

Once the electronic motor control unit has been actuated, the motor 190 rotates the toilet bowl 180 to the horizontal and locks the bowl in that position. The motor 190 continues to operate the gear box 192, which causes the toilet bowl 180 to rise along guide rails 194, controlled by a the synchronized leveling device 193.

In the preferred operation of the toilet compartment 30, a water flushing action occurs through the flushing water supply pipe 184 the entire time the toilet bowl 180 is being used. In addition, sensors (not shown) initiate the flushing action of the toilet bowl 180 when weight is added to the bowl.

After the user is finished with the toilet bowl 180, the button 187 may be depressed, reversing the motor 190 and returning the toilet bowl to the vertical position. If the user does not wish to depress the button 187, the toilet bowl 180 retracts automatically when the user opens the door 28 by the handle 168. Sensors (not shown) may be included that stop operation of the motor 190 if a foreign object is inserted in the pathway of the bowl 180. When the toilet bowl 180 is in the vertical position, the toilet bowl and the toilet seat 182 are within the housing 178.

High pressure water jet nozzles 202 are provided within the housing 178 for high pressure cleaning of the toilet bowl 180 and seat 184 when the bowl is in the vertical position. The fluid used to clean the toilet is a combination of water and chemical disinfectant and is supplied to the toilet compartment by a water pump 204 through high pressure flexible tubing 206. As can best be seen in FIG. 18, the water and disinfectant solution are routed to a dosing system 205 from a city water supply 207 and a chemical disinfectant reservoir 208, respectively. The dosing system 205 is equipped with a mixing valve that has a sensor with a timing mechanism. The timing mechanism is activated after the cleaning operation such that clean water can rinse the compartment. The disinfectant and water solution drain out of the drain (not shown) and trap (not shown) on the bottom of the housing 178.

A drying system is supplied for drying the toilet compartment 30 after the disinfecting and washing step. As can best be seen in FIG. 9, the drying system for the compartment 30 includes a centrifugal fan 212 with an electrical resistant heating element 214, such as is known in the heat drying art. Hot air formed by the centrifugal fan is transported by ducts 216 and supplied to a main diffuser 215 and pivotal, louvered vents 217. The pivoting and louvering of the vents prevents water from the disinfectant and water system from entering the drying system. The drying system is automatically engaged after the disinfecting stage has been completed and continues an adequate amount of time until the outside of the toilet bowl 180 and the toilet seat 182 are dry.

As can be seen in FIG. 11, the toilet compartment 30 forms a separate modular unit on the frame 90. This construction allows the entire compartment to be replaced with the minimum amount of maintenance. In addition, the toilet compartment 30 can be accessed by the maintenance panel 92 or by an additional access panel 218.

Figure 12:
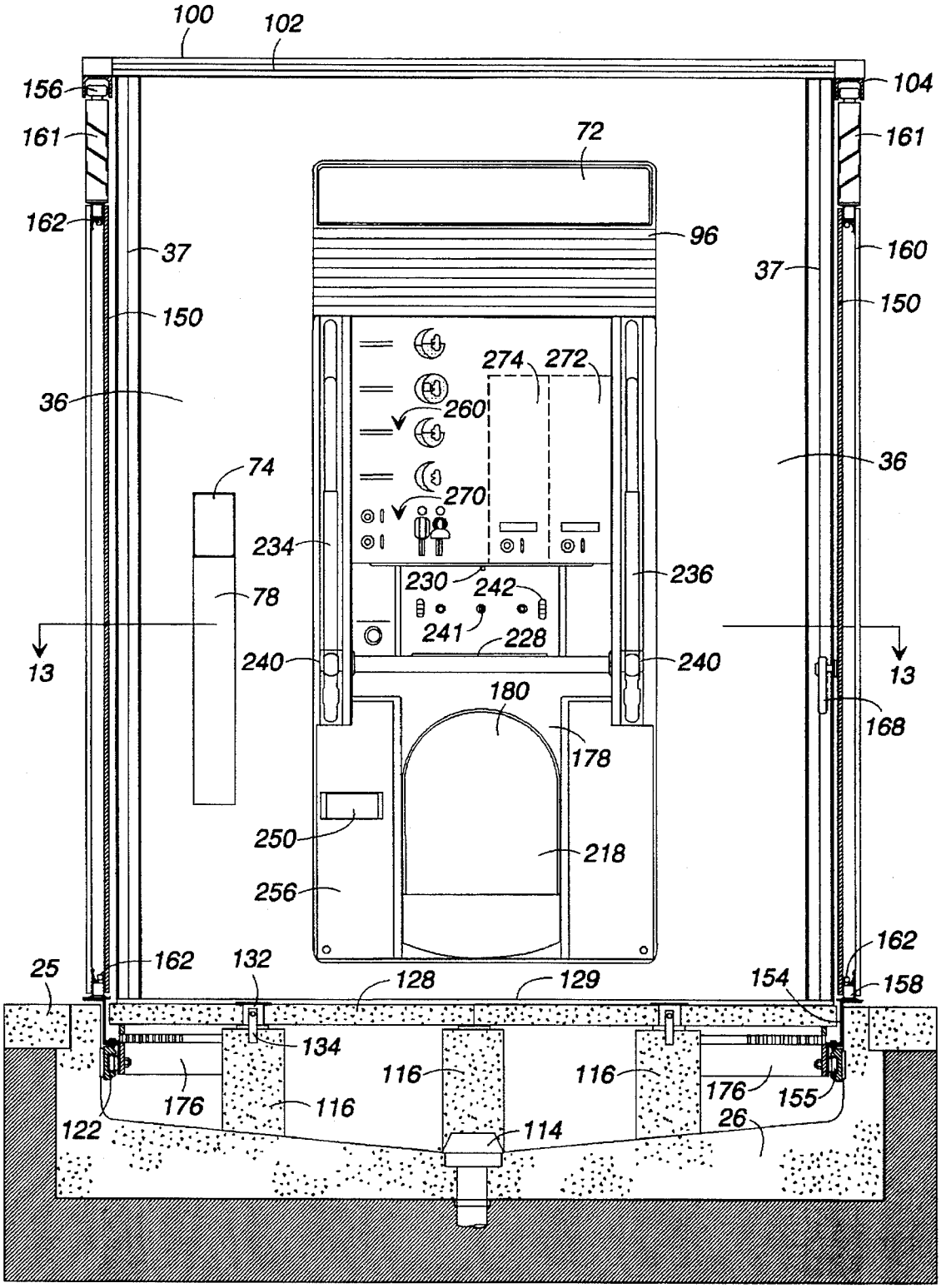
FIG. 12 is a front view of the equipment and machinery compartment of the facility of FIG. 1, with the double sliding doors in the opened position, and the toilet bowl in the vertical position.

Also included within the frame 90 is a lavatory compartment 220. Turning to FIGS. 9, 4, and 12, the lavatory compartment 220 includes a housing 222 in which is a conventional soap dispenser with a remote reservoir (not shown) and a water catch basin 224 with a drain 226 leading to a trap (not shown). A grill 228 is located over the basin 224. An infrared controlled faucet 230 is included over the catch basin 224 and preferably provides an elect-resistant water heating coil 225 (see FIG. 18) to supply warm water for washing. Located at the front of the water catch basin 224 is a horizontal grab bar 232. Like the toilet compartment 30, the lavatory compartment 220 may be equipped with high pressure water jets 241 and vents 242 for cleaning and drying the compartment. The jets 241 and vents 242 may be supplied pressurized fluid and hot air from the same sources as the toilet compartment 30.

Figure 18:
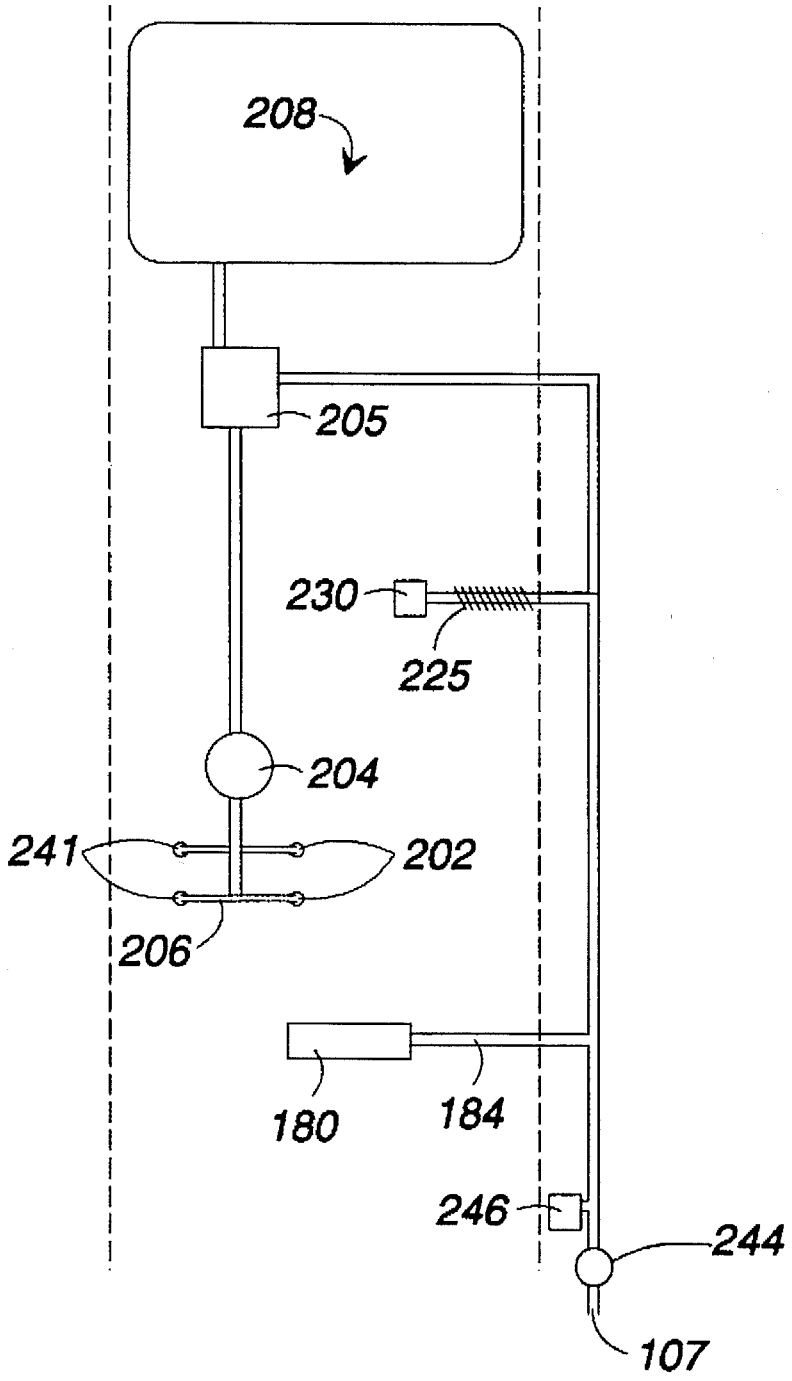
FIG. 18 is a schematic diagram of the water supply and distribution for the facility of FIG. 1.

The plumbing system of the facility 20 is set forth in FIG. 18 and has been described with reference to the toilet bowl 180, the disinfecting system, and the faucet 230. As with most plumbing systems, the plumbing of the facility also includes a backflow preventer 244 and a hose bib 246. A quick disconnect (not shown) is provided which allows connection to the water supply from the base 26. Similarly, quick disconnects (not shown) are provided within the compartment 24 for connection with electricity, phone service, storm water drain, and sewage drain.

In addition to drying the toilet compartment 30 and the lavatory compartment 220, the drying system, and more particularly the main diffuser 215, is used for hand drying within the lavatory. The drying system also provides a positive air pressure within the toilet compartment 30 and lavatory compartment 220 for ventilation purposes, and in cold weather provides a degree of preheating for the surfaces within the compartments. The drying system preferably includes adequate air filters to avoid blowing dust or particles on the sanitized surfaces within the compartments 30, 220.

Two grab bars 234, 236 are located on either side of the catch basin outside of the housing 222 and store vertically when not in use. The grab bars 234, 236 are pulled down manually to the horizontal position and have a motorized return activated by an electronic motor control unit (not shown) having a revolution counting sensor. The grab bars 234, 236 rotate about pivot attachments 240.

Adjustment of the height of the toilet bowl 180 is a convenient way to allow the toilet compartment 30 to be located below the lavatory compartment 220. The Americans with Disabilities Act (ADA) requirement for the level of a wash basin is a maximum of 34 inches, and the requirement for level of a toilet seat is a maximum of 19 inches. Given the ADA lavatory height maximum and the length of the toilet bowl 180, it is not possible for the toilet 180 to simply rotate 90° upwards, because a conflict would be created with the water catch basin 224, or the toilet bowl would not satisfy the minimum toilet height of 17 inches. Therefore, the axis of rotation for the toilet bowl 180 has been moved down to avoid the conflict with the water catch basin 224 and the height adjustment capability has been added to the toilet. Different variations could be made within the equipment and machinery compartment 24 to accommodate the necessary heights for the water catch basin 224 and toilet bowl 180.

As shown, the frame 90 also includes a toilet tissue dispenser 250 having a spring loaded mechanism (not shown) for supplying three individual continuous rolls of 254 of toilet paper. The toilet tissue dispenser may be accessed by the maintenance panel 256.

A control module 260 with a microprocessor is provided which is the central electronic control unit and is connected to all of the motors, activated systems, and sensors. A coin activated operator 270 of standard vending technology and which initializes the movement of the facility 20 from the "stand ready" position to the "in use" position, is integral to the control module 260, along with the motor control unit for the double sliding doors 54, 56, the motor control assembly for the semicircular door 28, the electronic motor control unit for the toilet compartment 30, the electronic motor control unit for the grab bars 234, 236, the control (not shown) for the disinfectant and dosing system, the control (not shown) for the drying system 210, and any other activated systems included as part of the facility 20. The control module 260 and internal microprocessor described may be a general purpose programmable microprocessor of a type well-known to those skilled in the art. Furthermore, such a microprocessor and the controls for the various components within the facility 20 may be programmed by a programmer of ordinary skill to accept the inputs, perform the functions, and provide the outputs required for operation of the present invention, given the description contained herein. The control module 260 may be equipped with a temperature sensor (not shown) and a timer (not shown). In addition, the control module 260 may be wired to a remote station such that the user may communicate to the remote station during the case of an emergency. Remotely-commanded overrides of the system may be provided for safety and maintenance reasons.

The operation of the facility 20 can be understood from the foregoing description. Before use, the semicircular door 28 is located in the stand-ready or opened position behind the compartment 24, exposing the front partial panel 36 with a coin operation machine 270 and instructions thereon. These instructions may be provided in Braille. By standing (or sitting in a wheelchair) in the proper position to insert a coin in the slot on the machine 270, the user is placed in the proper position to be removed from the rotation of the semicircular door 28. The interior volume of the facility 20 below the roof 22 is illuminated by fluorescent lighting supplied by the light fixture 72 in the semicircular door 28, and the light fixture 103 located within the roof assembly 22.

When a coin has been placed in the coin machine 270, the semicircular door 28 automatically rotates to enclose the space and the user. The door 28 is designed with motion detectors (not shown) and an automatic locking system (not shown) which can be manually opened by the handle 168 from the interior. Once the door is locked in place, there is a twenty minute time limit that is made visible to the user by a digital clock (not shown) on the control module 260. After the 20 minute time limit has expired, the door 28 opens.

Eighty percent closure of the semicircular door 28 automatically activates the opening of the double sliding doors 54, 56 to provide access to the toilet compartment 30, lavatory compartment 220, toilet tissue dispenser 250, control module 260, and grab bars 234, 236. A garbage receptacle 76 and sanitary products 272, 274 are also included. The toilet bowl 180 lowers to the horizontal position and raises to its final height. If wanted, the user may lower one or both of the grab bars 234, 236 to aid the user in accessibility.

Once the toilet bowl is in the desired position, weight sensors begin a constant flush cycle, with flushing water coming from the supply pipe 184 into the toilet. The drain clapper 186 prevents garbage from reaching the trap 198 and clogging the flushing system. The drain clapper 186 is equipped with an insulated interrupter switch (not shown) that prevents the toilet bowl 180 from being retracted while the clapper is forced back into the drain.

Once the user is finished, he or she may use the lavatory and may then manually close the toilet bowl 180 by pushing the same button 187. Once the toilet bowl 180 is retracted into the toilet compartment 30, the toilet compartment and lavatory compartment 220 are automatically disinfected by the high pressure water jets 202, 241 and then dried by the hot air from the vents 210, 242.

After the user has finished with the facility 20, he or she may open the semicircular door 28 by lifting on the handle 168. If the user has not pressed the button 187 to retract the toilet bowl 180, the bowl will automatically retract at this time. In addition, the grab bars 234, 236 will also retract at this time. As the semicircular door 28 is revolving back to the "stand ready" position, the double sliding doors 54, 56 close and the toilet compartment 30 and lavatory compartment 220 are disinfected (if not already disinfected). The user need not push the rotating semicircular door 28 all the way around to the start, because the motor control assembly 170 will return the door to the "stand ready" position once movement has begun. The facility 20 is now ready for the next user.

The facility 20 may supply advertising space along the advertising panel 160 or even along the back panel 32. Such advertising space can help pay for the cost of supplying the facility 20 in an area.

As can be understood from the foregoing description, the automatic, self cleaning, handicapped accessible, public toilet facility 20 described above displays a more efficient use of public space than that of the prior art. When not in use, the facility 20 takes up the sidewalk space equal to the cross section of the compartment 24, an area the shape of a crescent and much smaller than that of the prior art devices. The convenient construction allows sidewalk pedestrian traffic to continue by on roughly half of the diameter of the facility 20 when the facility is not in use.

In addition, the facility 20 exhibits a more efficient use of interior space. Prior art designs have used essentially two volumes, one for the users and another one of approximately equal size for equipment and machinery. In contrast, the facility 20 of the present invention consists of one volume that is created temporarily when the unit is occupied by the user and a compact equipment and machinery compartment 24. The toilet compartment 30, the lavatory compartment 220, the toilet tissue dispenser 250, and the control module 260 are attached to the frame 90 in a modular fashion for maximum compactness and ease of replacement.

The facility 20 as pictured and described is handicapped accessible, alleviating the need for two separate types of units in a public area. The facility 20 is also more sanitary than prior art structures. The unit is made primarily of metal and plastic, and the inside of what ultimately becomes the enclosure for the user is open to the exterior except when in use, thus dispersing odors more efficiently. The toilet bowl 180 is completely dried after disinfecting.

Garbage will not accumulate within the facility 20 because when the semicircular door 28 is in the "stand ready" position, the facility use area is open to the street. Thus, any garbage can be removed by any normal street cleaning activity.

In addition, the toilet bowl 180 of the present system is an improvement over prior art devices. Most of the devices of the public use toilets use either a porcelain or polyester bowl that retracts into the equipment compartment for spraying or brushing. In contrast, the facility 20 uses either a polyester or stainless steel bowl that rotates into a disinfecting chamber.

The facility 20 of the present invention also offers a convenient design which is capable of being relocated or reassigned to other areas. The facility 20 includes two major components: the pre-cast concrete base 26, and the compartment 24 with the roof assembly 22. The base 26 is installed in sidewalks and city services are attached to it. The separate compartment 24 is then lowered into position by the use of the lifts rings 106 and is bolted in place. Utilities and plumbing are quickly connected to the compartment 24, and the floor slab 128 is then inserted to cover the rest of the base 26.

If removal of the compartment 24 is desired, the compartment may be reassigned and replaced by the utilities slab 138. This configuration has the advantage of allowing municipalities to shuffle their facilities. For example, at a seasonal festival site it would be possible to install several bases 26 and only have the compartments 24 with the roof assembly 22 installed during the festival. The compartments 24 and roof assemblies 22 could be reassigned at other points during the year based on the cultural activities agenda of the city. In climates with severe weather it is possible to rapidly disconnect and remove the compartment 24 and roof assembly 22 and change the floor slab 128 with a weather slab (not shown, but similar to the utilities slab 138) that protects the interior of the base.

The facility 20 includes several provisions for the disabled, including the grab bars 232, 234, and 236, Braille instructions, and a toilet bowl 180 and water basin 232 which meet ADA height requirements. In addition, the control module 260 may be connected to the city telephone system, allowing remote monitoring or voice activated emergency intercom assistance. A panic button may be supplied in addition to the intercom service.

Finally, the facility 20 offers more discretion than that given by the prior art modules. Most of the prior art modules do little to mask the fact that they are merely toilets on the street, or are oversized advertising kiosks. The doors open on the prior art models, and anyone passing by sees a toilet and the person going into the unit. This visual image tends to make people self-conscious and embarrassed. At night when the door opens, a flood of lights fills out on the street announcing to everyone that the user is going in and the shiny toilet bowl is visible to all. In contrast, the facility 20, by virtue of the semicircular door 28, makes it almost impossible for someone outside the unit to simultaneously see the user and the toilet bowl 180. When the user approaches the unit and inserts money, the door closes behind the user and only then can the toilet bowl 180 be rotated down from its compartment. After use, the toilet bowl 180 is either closed manually by the user or retracts instantly after the door 28 begins to open. Night time illumination is low and constant. When the door 28 closes behind the user, a dimmer switch (optional, and not shown) increases the level of illumination to required levels within the compartment. While the facility 20 is closed, light still shines on the street from the advertising panel light fixture 162 and the roof light fixture 103. This nominal level of illumination also increased safety because the advertising panel is not the only source of illumination on the street.

While this invention has been described in reference to preferred embodiments thereof, it will be understood that variations and modifications can be effected within the spirit and scope of the invention as described herein before and as defined in the expended claims.

What is claimed is:

1. A public toilet facility, comprising:

a base portion having an uppermost peripheral horizontal surface, said base portion set within a suitable anchor, said anchor having a horizontal top surface, said uppermost peripheral horizontal surface and said horizontal top surface being coplanar, said base portion including a water supply line and waste disposal pipe;

a floor slab mounted in said base portion such that an upper surface thereof is coplanar with said uppermost peripheral horizontal surface and said horizontal top surface;

an equipment and machinery compartment, the compartment removably attached to the base portion and including:

a detachable water line for attaching to the water supply line; and a detachable waster disposal line for attaching to the waste disposal pipe;

a toilet attached to the equipment and machinery compartment along a first side of the compartment, the toilet connected to the detachable water supply line and the detachable waste disposal line; and a movable door operatively associated with the equipment and machinery compartment, the door operative from a first position where the first side of the equipment and machinery compartment is exposed to a second position to form an enclosure with the equipment and machinery compartment, the first side being contained within the enclosure and the toilet being accessible within the enclosure, the door being configured such that the door may be removed along with the equipment and machinery compartment.

2. The public toilet facility of claim 1, wherein the toilet is operatively connected to the equipment and machinery compartment such that the toilet is contained within the equipment and machinery compartment when the door is in the first position, and the toilet is operative to a position at least partially outside the compartment and accessible to a user in the enclosure when the door is in the second position.

3. The public toilet facility of claim 1, wherein the base is configured such that it may receive a utility slab upon removal of the compartment, the utility slab and the floor slab forming a complete cover for the base when the equipment and machinery compartment is removed.

4. The public toilet facility of claim 1, wherein the anchor is a sidewalk and the base portion is mounted flush with the sidewalk, and wherein the base is configured such that it may receive a utility slab upon removal of the compartment, the utility slab and floor slab being flush with the top of the sidewalk when the utility slab is in place.

5. A public toilet facility, comprising:

a base portion set within a sidewalk, the base portion being mounted flush with the sidewalk, the base portion including a water supply line and waste disposal pipe;

a floor slab within the base portion mounted flush to the top of the sidewalk;

an equipment and machinery compartment, the compartment removably attached to the base and including:

a detachable water line for attaching to the water supply line; and a detachable waste disposal line for attaching to the waste disposal pipe;

a toilet attached to the equipment and machinery compartment along a first side of the compartment, the toilet connected to the detachable water supply line and the detachable waste disposal line; and a movable door operatively associated with the equipment and machinery compartment, the door operative from a first position where the first side of the equipment and machinery compartment is exposed to a second position to form an enclosure with the equipment and machinery compartment, the first side being contained within the enclosure and the toilet being accessible within the enclosure, the door being configured such that the door may be removed along with the equipment and machinery compartment.

6. A public toilet facility, the facility capable of first and second configurations, the facility comprising:

a floor defining an outer circumference having a first and second length;

an equipment and machinery compartment including a toilet and defining a first wall which extends vertically from the first length of the circumference of the floor;

a roof connected to the equipment and machinery compartment and designed to cover a vertical projection of the floor; and a movable door operatively associated with the floor and the compartment such that:

in the first configuration of the toilet facility, the door is substantially removed from the second length of the circumference of the floor, such that the floor and the vertical projection of the floor are bordered substantially only along the first length by the first wall defined by the compartment; and in the second configuration, the door has been moved such that it forms a second wall about the second length of the circumference of the floor, the second wall, the first wall, the roof, and the floor forming an enclosure whereby the toilet may be accessed within the enclosure when the facility is in the second configuration.

7. The public toilet facility of claim 6, wherein the equipment and machinery compartment has a cross-sectional area which is crescent-shaped.

8. The public toilet facility of claim 7, wherein the floor fits against the inner edge of the crescent shape of the equipment and machinery compartment, such that a cross-section of the floor and the equipment and machinery compartment is substantially a circle.

9. The public toilet facility of claim 7, wherein the second length of the circumference is greater than the first length of the circumference.

10. The public toilet facility of claim 6, wherein the door is a rotating, semicircular door which fits into a groove which extends around the equipment and machinery compartment and the floor.

11. The public toilet facility of claim 10, wherein the semicircular door defines leading and trailing edges thereon, and the enclosure defines first and second edges thereon, and wherein in the first configuration, the leading edge of the semicircular door is adjacent to the first edge of the equipment and machinery compartment and the trailing edge of the semi-circular door is adjacent to the second edge of the equipment and machinery compartment, and wherein, in the second configuration, the leading edge of the semi-circular door is adjacent to the second edge of the equipment and machinery compartment and the trailing edge of the semi-circular door is adjacent to the first edge of the equipment and machinery compartment.

12. A public toilet facility, comprising:

a base portion set within a suitable anchor, the base portion including a water supply line and waste disposal pipe;

a floor slab within the base portion;

an equipment and machinery compartment, the compartment removably attached to the base and including:

a detachable water line for attaching to the water supply line; and a detachable waste disposal line for attaching to the waste disposal pipe;

the base being configured such that it may receive a utility slab upon removal of the equipment and machinery compartment, the utility slab and the floor slab forming a cover for the base when the equipment and machinery compartment is removed;

a toilet attached to the equipment and machinery compartment along a first side of the compartment, the toilet connected to the detachable water supply line and the detachable waste disposal line; and a movable door operatively associated with the equipment and machinery compartment, the door operative from a first position where the first side of the equipment and machinery compartment is exposed to a second position to form an enclosure with the equipment and machinery compartment, the first side being contained within the enclosure and the toilet being accessible within the enclosure, the door being configured such that the door may be removed along with the equipment and machinery compartment.

13. The public toilet facility of claim 12, wherein the anchor is a sidewalk and the base portion and floor slab are mounted flush with the sidewalk.

* * * * *